United States Patent [19]

Abernathy

[11] Patent Number: 4,953,750

[45] Date of Patent: Sep. 4, 1990

[54] DISPENSING METHOD FOR A VARIABLE VOLUME DISPOSABLE CARBONATED BEVERAGE CONTAINER

[76] Inventor: Frank W. Abernathy, 1518 River Bend Rd., Columbus, Ohio 43223

[21] Appl. No.: 332,581

[22] Filed: Apr. 3, 1989

[51] Int. Cl.[5] ..... B65D 23/02; B65D 25/16; B67D 5/00

[52] U.S. Cl. ..... 222/1; 222/94; 215/12.1; 220/404

[58] Field of Search ..... 215/12.1, 12.2; 220/404; 222/1, 105, 94, 95

[56] References Cited

U.S. PATENT DOCUMENTS 4,330,066 5/1982 Berliner ..... 220/404 X

FOREIGN PATENT DOCUMENTS 332725 4/1970 Sweden ..... 215/12.1

*Primary Examiner*—Sue A. Weaver

*Attorney, Agent, or Firm*—Mueller and Smith

[57] ABSTRACT

The purpose of this invention is to maintain a minimal air-liquid ratio in order to reduce cabonation losses in large, disposable beverage containers such as the plastic ones used to contain carbonated soft drinks. This is accomplished by reducing the volume within a collapsible, pressure-resistant bag within the container as the beverage is removed by sealing the bag at the air-liquid interface.

1 Claim, 1 Drawing Sheet

DISPENSING METHOD FOR A VARIABLE VOLUME DISPOSABLE CARBONATED BEVERAGE CONTAINER

BRIEF SUMMARY OF THE INVENTION

Carbonated soft drinks bottled in large plastic disposable bottles are noted for their tendency to lose carbonation very rapidly unless the soft drink is consumed within several days. Once the carbonation is lost, so is the taste. The purpose of this invention is to insure that once the bottle is opened, the carbonation can be retained over a much longer period of time, thereby increasing the popularity and marketability of carbonated beverages within large, plastic containers.

The invention has at least two advantages over the collapsible bottle design as described in U.S. Pat. No. 4,790,361. There is no need to redesign current disposable bottles. A plastic liner which is attached at its mouth to a plastic nozzle is inserted into pre-existing bottles, inflated, filled with liquid, and capped in the usual manner. When the contents of the bottle are partially removed, the inner liner is pulled out to the level of the liquid, twisted, and sealed with a twist tie analogous to how plastic garbage bags are tied off. It is then lowered back into the bottle and re-capped. One critical difference between this method and collapsible bottles is that once the latter is partially emptied and agitated, the pressure builds up which forces it to expand. This releases the pressure, lowers the carbonation, and defeats the original purpose of the container. However, in the bottle bag liner the pressure-resistant bag is tied off at the liquid/air interface which prevents any release of pressure within the remaining liquid, thus preserving carbonation.

DETAILED DESCRIPTION

Figure 1:
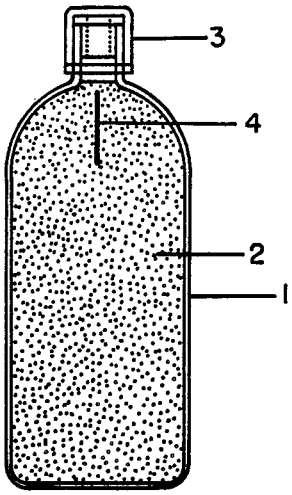
FIG. 1 is a cross sectional view of the carbonated beverage container in an upright position, sealed, and filled with liquid.
Figure 2:
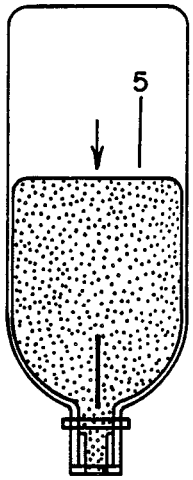
FIG. 2 is a cross sectional view of the carbonated beverage container in an inverted position, allowing the liquid contents to be poured out.
Figure 4:
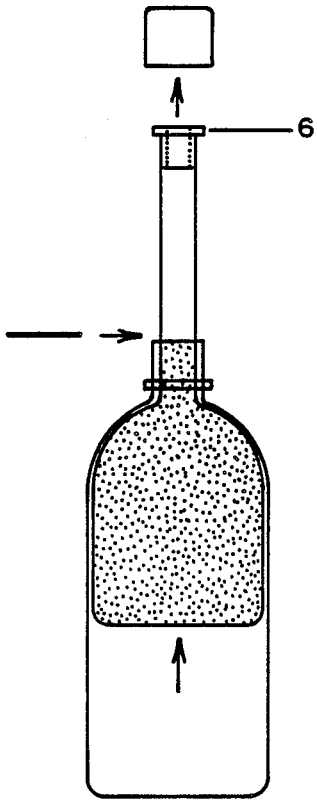
FIG. 4 is a cross sectional view of the carbonated beverage container in an upright position, where the bag has been pulled out of the container up to the liquid-/air interface.
Figure 3:
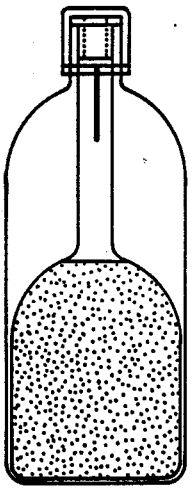
FIG. 3 is a cross sectional view of the carbonated beverage container in an upright position, allowing the remaining liquid contents to flow back into the bottom of the pressure-resistant bag.
Figure 5:
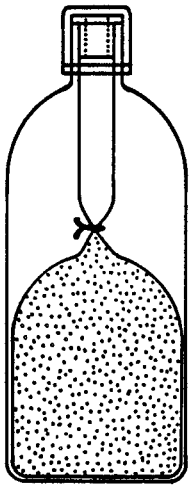
FIG. 5 is a cross sectional view of the carbonated beverage container in an upright position, where the bag has tied off at the liquid/air interface, lowered back into the container, and the container re-capped.

FIG. 1 illustrates the disposable container 1, the liquid contents 2, the container cap 3, and the twist tie 4 which is attached either to the bag or to the outside of the bottle for easy removal. In FIG. 2 the contents are being poured from the bottle and the bag 5 collapses. In FIG. 3 the bottle has been returned to its original position, allowing the liquid contents to flow back into the bottom of the bag. FIG. 4 illustrates how the bag is pulled out of the bottle up to its liquid/air interface by grasping the nozzle 6 which is either heat-sealed or taped to the neck of the bag. The twist tie has been removed and is in position for tying off the bag at the liquid/air interface. In FIG. 5 the bag has been tied off at the liquid/air interface, lowered back into the container, and the container re-capped.

The foregoing illustrates only the principles of the invention and numerous modifications and changes will readily occur to those skilled in the art. Therefore, it is not desired to limit the invention to the exact construction and operation shown and described and, therefore, all suitable modifications and equivalents may be resorted to, falling within the scope of this invention.

I claim:

1. A method for retaining carbonation in carbonated beverages which comprises:

supplying an inner collapsible bag liner filled with a liquid carbonated beverage and having a mouth attached to a nozzle and which filled liner is placed within a container having an opening wherein said nozzle retains said liner mouth at said container opening;

dispensing said carbonated beverage from said liner; and after said dispensing, tying off said liner at the liquid-/air interface so as to prevent loss of carbonation from said carbonated beverage in said liner.

* * * * *